United States Patent [19]

Kienberger et al.

[11] 4,210,915

[45] Jul. 1, 1980

[54] MICROWAVE ANTENNA WITH EXPONENTIALLY EXPANDING HORN STRUCTURE

[75] Inventors: Karl-Heinz Kienberger, Schopfheim-Wiechs; Don J. R. Stock, Schopfheim-Langenau, both of Fed. Rep. of Germany

[73] Assignee: Endress u. Hauser GmbH u. Co., Maulburg, Fed. Rep. of Germany

[21] Appl. No.: 946,367

[22] Filed: Sep. 27, 1978

[30] Foreign Application Priority Data

Oct. 5, 1977 [DE] Fed. Rep. of Germany ..... 2744841

[51] Int. Cl.[2] ..... H01Q 13/02

[52] U.S. Cl. ..... 343/786; 343/772

[58] Field of Search ..... 343/786, 772, 773-779, 343/755

[56] References Cited

U.S. PATENT DOCUMENTS

| | | | |
|---|---|---|---|
| 3,814,890 | 6/1974 | Klemp et al. | 343/786 |
| 3,864,683 | 2/1975 | Mörz | 343/786 |

*Primary Examiner*—David K. Moore

*Attorney, Agent, or Firm*—Gerald J. Ferguson, Jr.; Joseph J. Baker

[57] ABSTRACT

A microwave antenna having an exponentially expanding horn of circular outlet cross-section. The inlet opening to the horn has a rectangular cross-section. In a transition region from the inlet opening up to the point at which the circular horn cross-section circumscribes the rectangular cross-section, each cross-section of the horn corresponds to the combination of the exponentially expanding circular cross-section and the rectangular cross-section.

8 Claims, 8 Drawing Figures

MICROWAVE ANTENNA WITH EXPONENTIALLY EXPANDING HORN STRUCTURE

Figure 1:
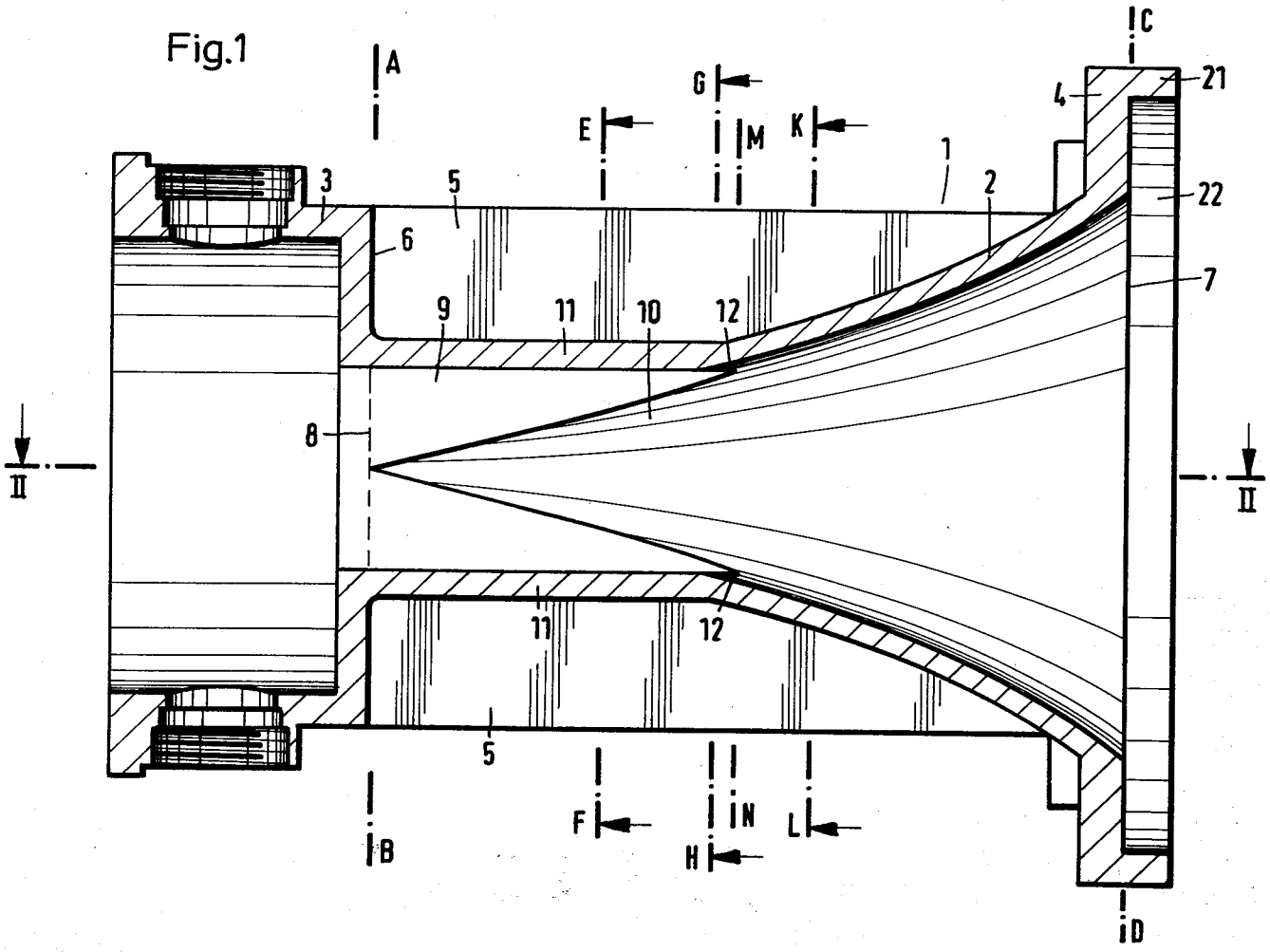

The invention relates to a micro-wave antenna comprising an exponentially expanding horn of circular outlet cross-section.

In certain fields of use, problems exist with regard to the fixing and spatial accommodation of such micro-wave antennae. This applies, for example, when the micro-wave antenna is to be mounted on a container as a measuring sensor for measuring the level of filling. In this case, the outlet from the horn must be fixed to the container wall opposite an opening formed therein. This generally takes place by means of a flange or of a screw-in portion. However, this kind of fixing is generally only possible when the horn opening has a circular outlet cross-section.

Furthermore, in view of the often limited available space, a constructional length for the micro-wave antenna as short as possible is required. For this purpose, it is known to arrange a micro-wave oscillator, for example a Gunn diode-oscillator, directly at the horn input which is directly coupled to the horn. Since such oscillators generally have a resonator formed by a rectangular wave guide, this construction requires the connection to a horn having a rectangular cross-section which, however, as explained earlier, is very unsuitable for fixing by means of a flange or a screw-in portion.

Transition portions are indeed known which provide a transition from a rectangular wave guide to a circular horn but such transition portions must have a length of one to two wave lengths so as to guarantee a reflection-free matching. Thus, the use of such a transition portion would considerably further increase the constructional length.

When the micro-wave antenna is used for a micro-wave chamber, for counting purposes for example, it must be freely mountable. Thus, so that the same micro-wave antenna is versatile as to its use, it is desirable to construct it so that it is suitable both for flange fitting and for a free mounting.

An object of the invention is the provision of a micro-wave antenna comprising an exponentially expanding horn which, with a very short constructional length, permits the direct connection of a micro-wave oscillator with a rectangular outlet cross-section and is not only suitable for flange fitting but also for free mounting.

This problem is solved in accordance with with invention in that the input opening to the horn has a rectangular cross-section and that in a transition region from the inlet opening up to the point at which the circular horn cross-section circumscribes the rectangular cross-section, each cross-section of the horn corresponds to the combination of the exponentially expanding circular cross-section and the rectangular cross-section.

With the micro-wave antenna according to the invention, the transition from the rectangular cross-section to the circular cross-section takes place within the horn itself, thus within the constructional length of a comparable horn with a uniform cross-section. It has been established, that the stated gradual change in the cross-sectional shape provides a reflection-free matching which does not lead to the existence of interfering wave forms. In this manner, it is possible to couple a micro-wave oscillator which requires a rectangular inlet cross-section directly to a horn radiator with a circular outlet cross-section. Thus, a micro-wave antenna with a built-on oscillator may be produced which, whilst being of very short construction, produces a good convergence.

Furthermore, the stated shape of the horn may also be produced simply by a casting technique so that the entire micro-wave antenna can be produced as a unitary casting.

Preferably, a chamber for receiving a micro-wave oscillator is formed at the inlet to the horn.

As a result of the circular outlet cross-section, the micro-wave antenna can be mounted on a wall so that the mouth of the horn is arranged at the wall. For this purpose, a marginal flange is preferably formed at the mouth of the horn; fixing of the horn on a wall lying in front of the mouth of the horn then takes place by means of a clamping ring gripping the marginal flange.

On the other hand, it is possible to also mount the same micro-wave antenna including the incorporated micro-wave oscillator free-standing; for this purpose, a foot is preferably mounted on the chamber arranged for the reception of the micro-wave oscillator.

In many applications, a horn with a higher gain is required, for example in the case of measuring the filling level when the form of the extension represents a problem. With the described construction of micro-wave antenna, this can easily be achieved by an extension funnel fixed to the marginal flange.

Figure 2:
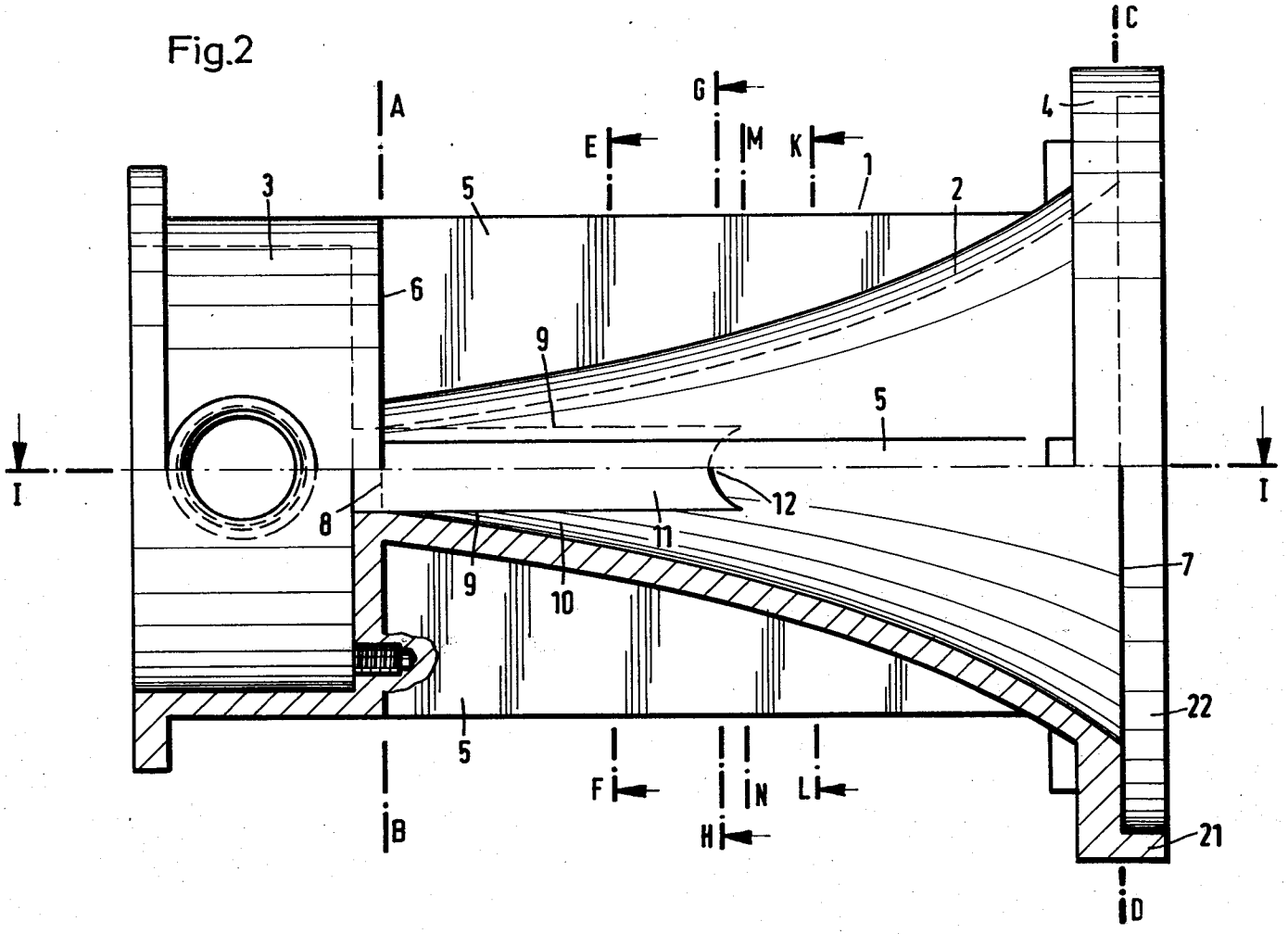
Figure 3:
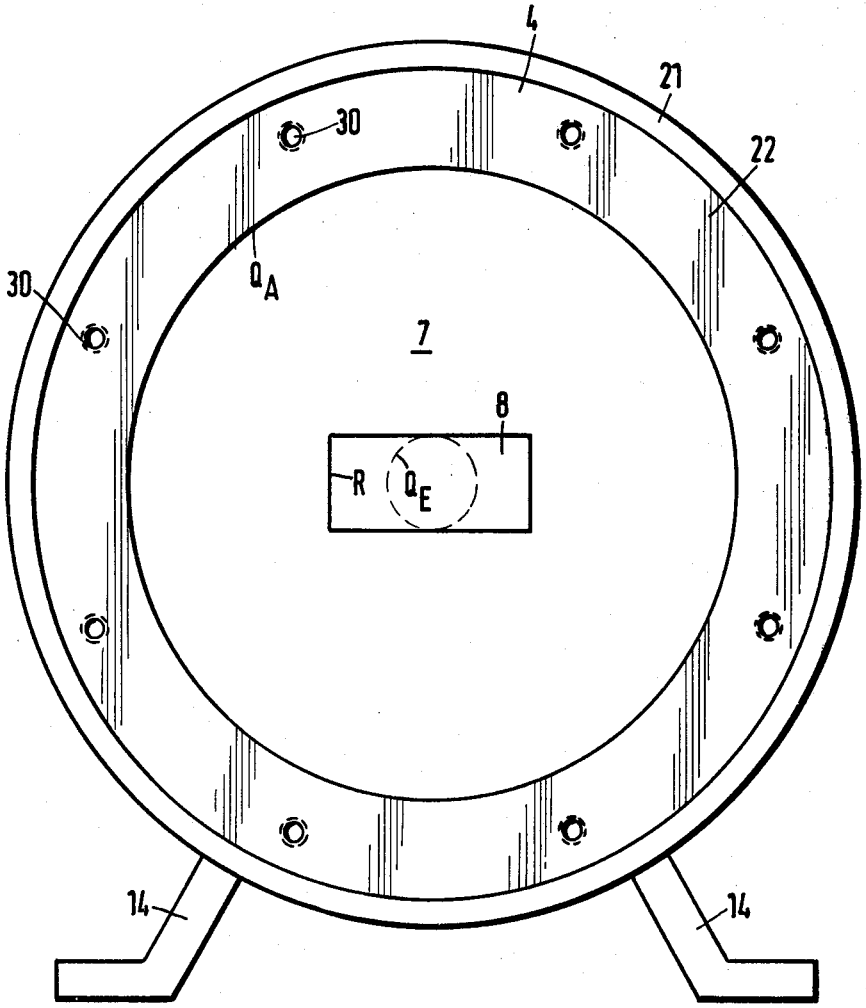
Figure 4:
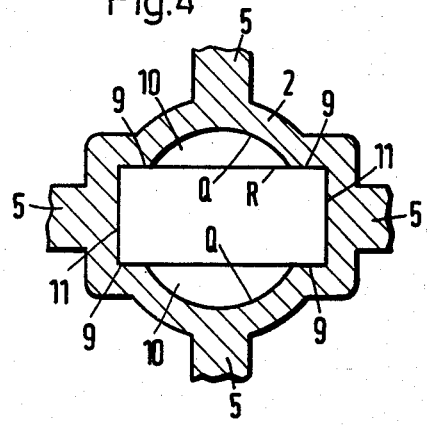
Figure 5:
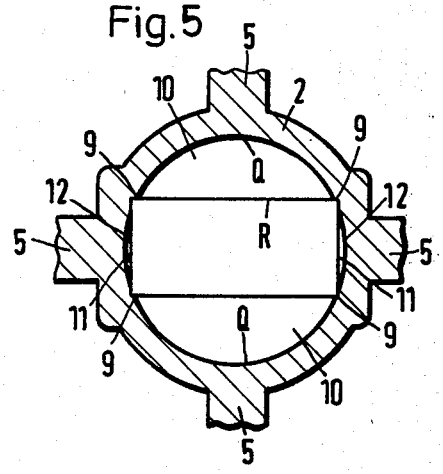
Figure 6:
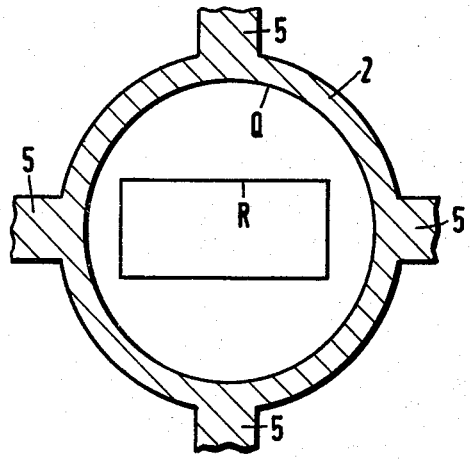
Figure 7:
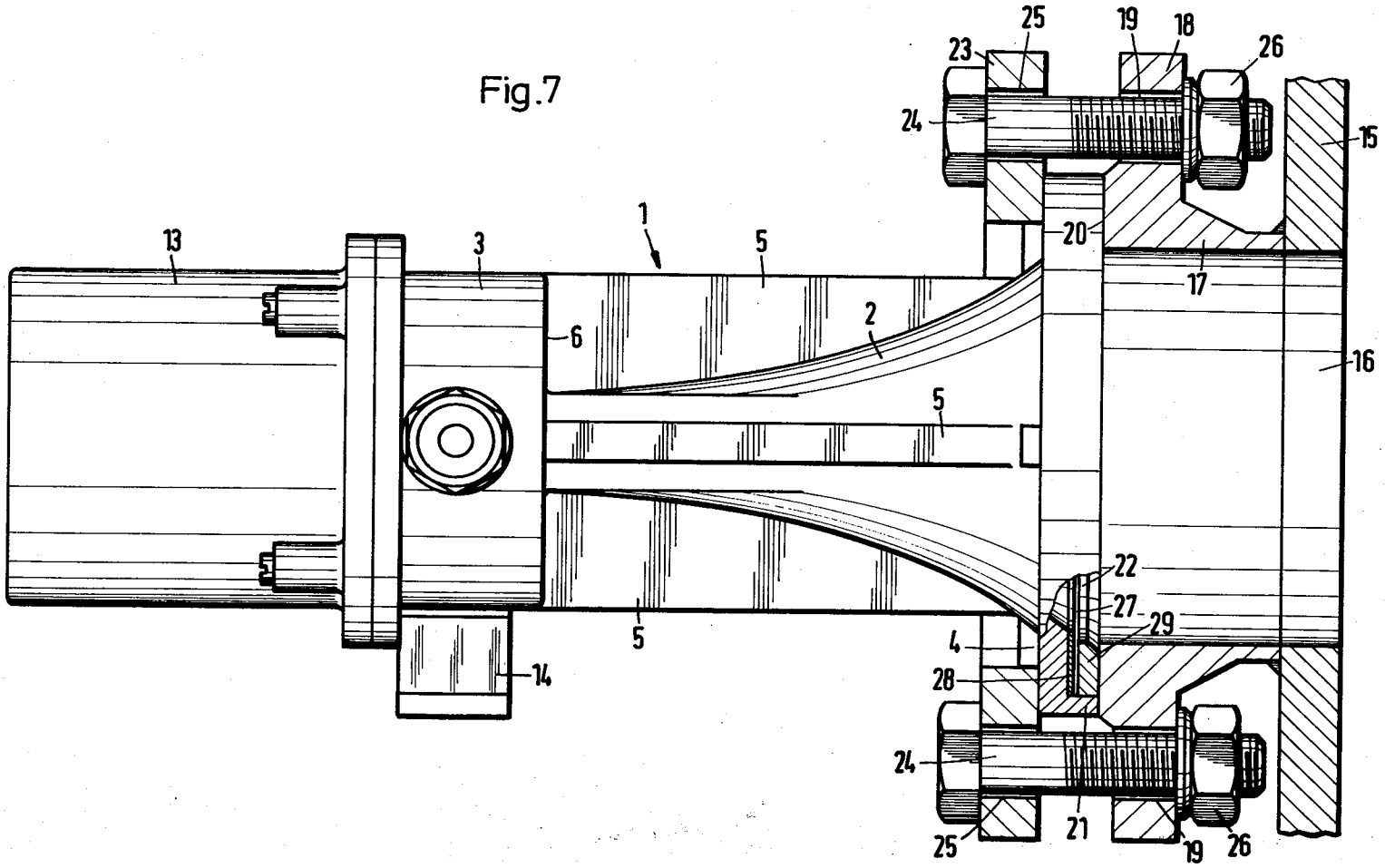
Figure 8:
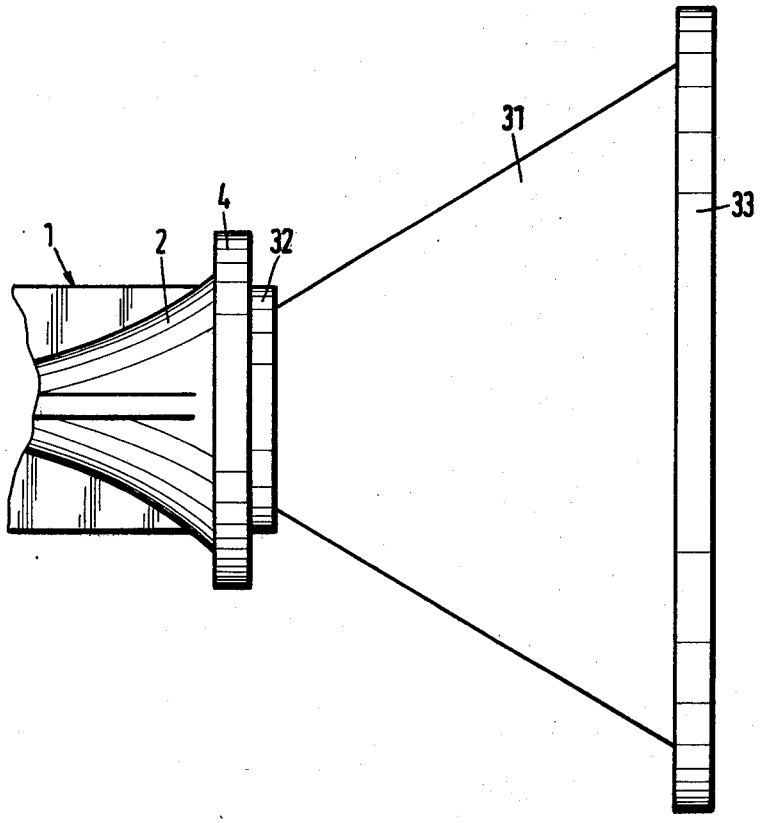

Further features and advantages of the invention will become apparent from the following description of an embodiment by way of example with the aid of the drawing. In the drawing:

FIG. 1 shows an axial longitudinal section through the micro-wave antenna according to the invention wherein the section lies in the plane I—I in FIG. 2, FIG. 2 is a side view of the antenna in FIG. 1 which is sectioned in the lower half in the plane II—II in FIG. 1, FIG. 3 is an end view of the antenna of FIGS. 1 and 2, FIG. 4 is a cross-section through the horn in the plane e-f in FIGS. 1 and 2, FIG. 5 is a cross-section through the horn in the plane g-h in FIGS. 1 and 2, FIG. 6 is a cross-section through the horn in the plane k-l in FIGS. 1 and 2, FIG. 7 is a side view of the antenna illustrating a flange fixing and FIG. 8 shows the antenna with an extension funnel mounted on the horn.

The micro-wave antenna 1 illustrated in FIGS. 1 and 2 of the drawings is a unitary casting or moulding, the main portion of which is an exponentially expanding horn 2 to the inlet of which is added a circular chamber 3 open at the rear and to the outlet side of which is added a likewise circular marginal flange 4. Four longitudinal webs 5 arranged at right-angles to one another extend from the radial closure wall 6 of the chamber 3 in an axial direction along the outside of the horn 2; these longitudinal webs serve for strengthening the horn.

The horn 2 proper extends from an inlet plane a-b which coincides with the outer surface of the closure wall 6 of the chamber 3, up to an outlet plane c-d (FIG. 2). The mouth 7 of the horn lying in the outlet plane c-d has a circular cross-section $q_a$, as can be appreciated from FIG. 3; on the other hand, the inlet opening 8 to the horn 2 lying in the inlet plane a-b and which is formed by an aperture in the closure wall 6, has a rectangular cross-section R which can likewise be appreciated from the end view of FIG. 3.

When, "cross-section" of the horn radiator is talked about in this connection and in the following description, then the cross-section of the free inner space bounded by the horn walls and always arranged perpendicular to the horn axis, is meant thereby.

Thus, in the longitudinal direction of the horn radiator, two different regions can be defined which are separated from one another by a plane m-n;

in the region between plane m-n and the outlet plane c-d, the horn radiator has a circular cross-section Q at all points, the diameter of which increases according to an exponential function up to the outlet cross-section $q_a$;

in the region between the inlet plane a-b and the plane m-n, a gradual transition takes place from the rectangular cross-section R at the inlet opening to the circular cross-section Q.

The plane m-n lies at the points at which the circular cross-section Q just circumscribes the rectangular cross-section R.

If the circular cross-section Q were to be extended uniformly with an exponential covergence up to the inlet plane a-b, then the circular cross-section $q_e$ shown in FIG. 3 would exist at that plane which would be just inscribed within the rectangular cross-section R and the two broad sides of the rectangular cross-section would each be tangential in their centres.

In the transition region between the planes a-b and m-n each cross-section of the horn radiator follows the outline of the circular cross-section Q existing at this point due to the exponential expansion, insofar as the latter lies outside the rectangular cross-section R, whilst it follows the outline of the rectangular cross-section R insofar as it lies outside the circular cross-section Q. Thus, at each point in the transition region, the entire cross-section corresponds to the combination of the rectangular cross-section R and the circular cross-section Q.

Thus, in this transition region, the shape of the horn 2, proceeding from the inlet opening 8, first of all thoroughly resembles the shape of a rectangular wave guide the broad side 9 of which has an outwardly curved round shape 10 expanding conically towards the mouth 7, whereas, over the greater portion of the length of the transition region, the narrow sides 11 retain their plane form and only join the circular cross-section Q of the horn 2 through outwardly curved round portions 12 shortly before the plane m-n.

In the sectional view of FIG. 4, which lies in the plane e-f in FIG. 2, can be seen the still completely existing narrow sides 11 of the rectangular cross-section R, the still existing plane sections of the broad sides 9 and the circular outwardly curved portions 10 which correspond to the sections of the circular cross-section Q at the two broad sides 9 lying outside the rectangular cross-section R. In the sectional view of FIG. 5, which lies in the plane g-h, the broad sides 9 have been practically completely incorporated within the outwardly curved portions 10 and the circular cross-section Q also intersects the narrow sides 11. Thus, there exist at the narrow sides 11, circular curved portions 12 likewise outwardly directed which finally change into a complete circular cross-section in common with the curved portions 10 in the plane m-n.

In the sectional view of FIG. 6, which lies in the plane k-l, the horn has assumed the circular cross-section Q completely which is now larger than the rectangular cross-section R.

The described construction of the horn radiator permits, within the constructional length of a normal horn radiator, a transition from a rectangular cross-section to a circular cross-section which provides a reflection-free matching and does not lead to the existence of undesirable wave forms. A round aperture with considerable convergence and with a very short construction can be achieved thereby. Furthermore, this form of horn radiator is also easy to produce by casting.

A micro-wave oscillator with a rectangular resonator cavity can be accommodated in the chamber 3 the oscillator then being coupled through the rectangular inlet opening 8 directly to the horn 2. The associated electronic apparatus can be accommodated in a housing 13 which is fixed to the open back end of the chamber 3 as shown in FIG. 7.

A foot 14 can be mounted on the chamber 3 by means of which the entire micro-wave antenna including the micro-wave oscillator accommodated in the chamber 3, can be fixed to a base. This method of fixing is particularly desirable when the micro-wave antenna is to be mounted free-standing as a component of a micro-wave chamber.

For other purposes, for example for measuring the filling level in containers, it is necessary to so arrange the micro-wave antenna that the mouth of the horn lies opposite an opening in one wall. The manner in which the fixing of the previously-described micro-wave antenna can be effected in this case is illustrated in FIG. 7. This figure shows the wall 15 of a container in which an opening 16 is made. At the outer surface of the wall 15, which can be plane or curved, a cylindrical fixing union 17 is welded around the opening 16. A radially projecting flange 18 is formed on the fixing union 17 and in which are formed a plurality of bores 19 distributed around the periphery. The side 20 of the fixing union 17 remote from the wall 15 is plane and has an outer diameter which is at least equal to the outer diameter of the marginal flange 4. An axially forwardly extending peripheral rim 21, which surrounds a shallow circular recess 22 arranged in front of the horn mouth, is formed at the periphery of the marginal flange 4. The surface of the peripheral rim 21 of the microwave antenna is applied to the surface 20 of the fixing union 17. Fixing takes place with the aid of a clamping ring 23, engaging the back of the annular flange 4, which is tightened against the flange 18 by means of threaded bolts 24 which are introduced through bores 25 in the clamping ring 23 and through the bores 19 in the flange 18 and thus forces the peripheral rim 21 against the side surface 20.

If a seal is required between the interior of the container and the micro-wave antenna, a round window 27 transparent to the micro-waves, for example a disc of polytetrafluorethylene, can be inserted in the recess 22 with the interposition of a sealing ring 28. A retaining ring 29 holds the disc 27 in the recess 22 and generates the necessary applied pressure for the sealing ring 28. The retaining ring 29 is fixed in the recess 2 by countersunk screws (not shown) which are screwed into threaded bores 30 in the marginal flange 4.

In many cases a horn with a greater gain is required. For this purpose, an extension funnel 31 can be provided (FIG. 8) which likewise has a circular cross-section. At the rear end, the extension funnel 31 has a flange 32 which fits into the recess 22 and can be connected to the marginal flange 4 by bolts which are screwed into the threaded holes 30 (FIG. 3) which are formed in the marginal flange 4. At the outlet end, the extension funnel 31 has an annular peripheral flange 33 which once again permits, if desired, fixing to a wall in the manner shown in FIG. 7. It is not necessary for the extension funnel 31 to expand exponentially; a linear expansion in the form of a straight line circular cone is sufficient.

If desired, the window 23 shown in FIG. 7 can also be inserted between the marginal flange 4 and the flange 32 on the extension funnel 31.

We claim:

1. A micro-wave, horn-type antenna having a longitudinal axis, said antenna comprising an outlet portion having a circular inlet opening and a circular outlet opening, the diameter of the outlet portion decreasing exponentially along said longitudinal axis from said circular outlet opening to the circular inlet opening; and a transition portion having a rectangular inlet opening and a circular outlet opening which coincides with the circular inlet opening of the outlet portion, each cross-section of said transition region in a plane perpendicular to said longitudinal axis following the outline of a circle obtained by exponentially decreasing the diameter of said circular outlet opening thereof to the plane of said cross-section in accordance with the same rate of exponential decrease which occurs between said circular outlet and inlet openings of the output region insofar as the circular outline lies outside of a projection of said rectangular inlet opening onto the plane of said cross-section, the remainder of said outline comprising said projection of the rectangular inlet opening, said circular outlet portion of the transition region circumscribing a projection of the rectangular inlet opening onto the plane containing the last-mentioned circular outlet opening; and said rectangular inlet opening inscribing an imaginary circle obtained by decreasing the diameter of said circular outline to the plane of said rectangular outlet opening at said same rate of exponential decrease.

2. A micro-wave antenna according to claim 1 where a chamber for the reception of a micro-wave oscillator is provided at the rectangular inlet opening of the transition portion.

3. A micro-wave antenna according to claim 2 where a foot is mounted on the chamber so that said antenna including the oscillator may be attached to a base.

4. A micro-wave antenna according to one of claims 1, 2 or 3 where a marginal flange is formed at the circular outlet opening of the outlet portion of the antenna.

5. A micro-wave antenna according to claim 4 including a clamping ring engaging the marginal flange for attaching the horn to a wall.

6. A micro-wave antenna according to claim 4 including an extension funnel which can be fixed to the marginal flange.

7. A micro-wave antenna according to one of claims 4 where a peripheral rim, which surrounds a shallow recess, is formed on the marginal flange and a window transparent to micro-waves is inserted in the shallow recess.

8. A micro-wave antenna according to claim 7 where the window is a disc of polytetrafluorethylene.

* * * * *